US006670587B1

(12) United States Patent
DiSalvo

(10) Patent No.: US 6,670,587 B1
(45) Date of Patent: Dec. 30, 2003

(54) SELF HEATING THERMAL PROTECTOR

(75) Inventor: Nicholas L. DiSalvo, Levittown, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/218,227

(22) Filed: Aug. 13, 2002

(51) Int. Cl.[7] ..... H05B 1/02; H01J 7/24

(52) U.S. Cl. ..... 219/494; 219/511; 315/118; 362/364; 174/52.1

(58) Field of Search ..... 219/482, 490, 219/494, 507, 509, 510, 511, 512; 174/52.1; 315/117, 118, 309; 361/103, 211; 362/145, 148, 276, 296, 364; 337/22, 380

(56) References Cited

U.S. PATENT DOCUMENTS

| | | | | | |
|---|---|---|---|---|---|
| 1,767,582 | A | * | 6/1930 | Fisher | 315/309 |
| 4,400,673 | A | * | 8/1983 | Gilman | 337/380 |
| 4,420,802 | A | * | 12/1983 | Smester et al. | 362/364 |
| 4,694,223 | A | * | 9/1987 | Campolo | 315/118 |
| 4,861,943 | A | * | 8/1989 | Yarmark | 174/52.1 |
| 5,978,196 | A | * | 11/1999 | O'Boyle | 361/103 |

* cited by examiner

*Primary Examiner*—Tu Ba Hoang
(74) *Attorney, Agent, or Firm*—Paul J. Sutton

(57) ABSTRACT

The present invention is a self heating thermal protector located in close proximity to an incandescent light fixture for controlling the flow of current to the associated lighting fixture by measuring the rate of heat flow from a dedicated heat source. Current is permitted to flow to the lighting fixture when the temperature of the self heating thermal detector is sufficient to avoid deterioration of electrical components such as plastic parts and wire insulation in the associated fixture. The thermal detector interrupts the flow of current to the associated fixture when the temperature of the self heating thermal protector increases to a temperature that is not safe.

Specifically, the self heating thermal protector of the present invention uses a resistor as a heat source, a bimetallic element as a switch located within a thermally conducting enclosure located proximate the heat source for controlling the flow of current to a fixture and thermally conductive potting compound which encapsulates both the heat source and the bimetallic element. The potting compound provides good thermal conductivity between the resistor, the bimetallic element and the surrounding air. A mounting member for mounting the thermal detector to a junction box is composed of thermally insulating material and provides dual functions, one of mounting the thermal detector to a junction box, and a second of thermally isolating the thermal protector from the junction box.

10 Claims, 1 Drawing Sheet

SELF HEATING THERMAL PROTECTOR

BACKGROUND OF THE INVENTION

1. Field of the Invention

The present invention relates generally to thermal protectors and more specifically to a self heating thermal protector for use in protecting recessed incandescent lighting fixtures.

2. Background of the Invention

Recessed fixtures provide architecturally desirable illumination in homes, offices and commercial buildings. Offices and commercial buildings are generally designed for hung ceilings to accommodate electrical conduit and heating and ventilating ducts. In the past the space above the ceiling has been either empty or filled with the aforementioned equipment with air spaces between the equipment. Under these conditions the greatest danger has been overlamping, a condition which exists when a lamp of larger wattage than the fixture is rated for is installed in the fixture. When a larger wattage lamp is used, the heat generated in the fixture is not dissipated quickly enough and the fixture temperature increases to a level that is higher than intended by the fixture designer. If the fixture is operated with the larger lamp, the resulting fixture temperature will rise to a point where charring of plastic parts and wire insulation within and about the fixture can occur. Eventually, deterioration of the fixture components may result in a fire. Fires from overheated lighting fixtures have caused extensive property damage.

Currently, because of increased concern with energy conservation, local and federal agencies are sponsoring programs in which homes and commercial buildings are being insulated as they are built. Existing homes and commercial buildings are normally insulated by forcing thermal insulation into the spaces which are to be insulated.

Building codes require that a barrier be constructed around recessed fixtures to prevent thermal insulation from coming into contact with the fixture. For new structures the foregoing requirement is costly but feasible. The installation of barriers around recessed fixtures in existing structures is relatively expensive and difficult to achieve.

Materials used in the construction of recessed fixtures are thermally rated for the application. Such materials are lamps, sockets, wire and insulation to name a few. The overheating problem due to overlamping and of thermal insulation installed in contact with the fixture exists with all type of fixtures but may be particularly serious with respect to recessed incandescent fixtures.

The possibility of relying upon the heat generated by the lamp in its fixture and its rate of dissipation as an indicator of safe operation has been considered. However, because of the variety of fixtures and lamp sizes and the cost involved of adapting a thermal protector to each specific application, a universal solution of using a self heating thermal protector described herein is proposed.

Safe operation of a recessed fixture depends upon the fixture dissipating a predetermined quantity of heat to its surroundings. The required heat flow is obtained by the air in contact with the fixture removing the heat. The air in contact with the fixture will heat up as it absorbs heat and the heated air, being lighter, rises allowing cooler air to flow in. This continual movement of air dependably cools the fixture. If air movement is restricted by thermal insulation, heat build up will occur resulting in a dangerous situation.

SUMMARY OF THE INVENTION

The present invention is a self heating thermal protector for controlling the flow of current to a lighting fixture by measuring the rate of heat flow from a dedicated heat source located in close proximity to the incandescent light fixture. Current is permitted to flow to the lighting fixture when the temperature of the self heating thermal detector is sufficient to avoid deterioration of electrical components such as plastic parts and wire insulation in the associated lighting fixture. The thermal detector interrupts the flow of current to the associated fixture when the temperature of the self heating thermal protector increases to a temperature that is not safe.

Specifically, the self heating thermal protector of the present invention uses a resistor as a heat source, a bimetallic element as a switch located within a thermally conducting enclosure located proximate the heat source for controlling the flow of current to a lighting fixture and thermally conductive potting compound which encapsulates both the heat source and the bimetallic element. The potting compound provides good thermal conductivity between the resistor, the bimetallic element and the surrounding air. A mounting member for mounting the thermal detector to a junction box is composed of thermally insulating material and provides dual functions, one of mounting the thermal detector to a junction box, and a second of thermally isolating the thermal protector from the junction box.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which:

DESCRIPTION OF THE PREFERRED EMBODIMENT

Self heating thermal protectors are used in recessed lighting fixtures to prevent fires which result, either directly of indirectly from overheated recessed lighting fixtures. The space around recessed lighting fixtures must be kept free of thermal insulation to allow some of the heat generated by the recessed lighting fixture to dissipate. In instances where the space around a recessed lighting fixture is filled with insulation, such as when insulation is added to a home to reduce drafts or heat loss, the transfer of heat away from the recessed lighting fixture and the self heating thermal protector will be reduced and the temperature of the fixture and the thermal protector will increase. This increase in temperature will cause a switch in the thermal protector to open which removes power from the recessed lighting fixture. This prevents the recessed lighting fixture from overheating and damaging the wiring insulation and surrounding building materials. At some time after power to the fixture has been stopped, the self heating thermal protector will cool sufficiently to allow the switch to close and power will be restored to the fixture. At some instant thereafter the fixture will again become too hot, the switch in the thermal protector will open and power will be removed form the fixture. This on-off cycling of the fixture will cause the light in the fixture to turn on and off at a very slow rate as long as power is applied to the fixture. The blinking light is an indication that a problem exists with the fixture installation. With a proper installation, no insulation surrounds the fixture and the thermal conductivity of the self heating thermal protector transfers sufficient heat to the surrounding air to keep the bimetallic switch from opening and the light in the fixture continuously on.

In this invention, the self heating thermal protector comprises a resistor as a heat source, a bimetallic element as a switch for controlling the flow of current to a fixture positioned proximate the heat source and thermally conductive potting compound encapsulating both the heat source and the switch. The encapsulating material provides good thermal conductivity between the resistor, the bimetallic element and the surrounding air. A mounting member of thermal insulating material is coupled to an end of the self heating thermal protector. The mounting member has a dual function, one of providing a convenient method for mounting the thermal protector and a second function of thermally isolating the thermal protector from the mounting structure. In a typical application, the thermal protector is mounted to an electrical junction box which is usually made of metal and, therefore, is a good thermal conductor. Thermal isolation from the junction box is desired to minimize it's influence on the thermal protector so that it remains primarily responsive to the surrounding air.

Figure 1:
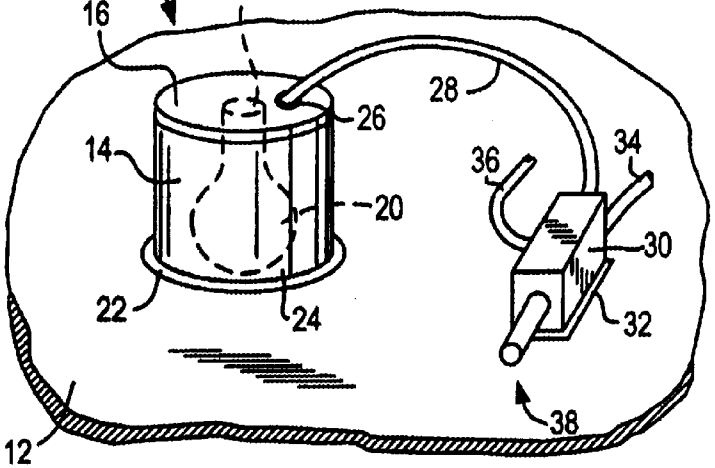
FIG. 1 illustrates the present invention operatively connected to a recessed fixture.

FIG. 1 illustrates an application of the present invention and is generally designated 10. The application 10 shows a typical hung ceiling arrangement wherein a hung ceiling 12 supports a high hat fixture 14. High hat fixture 14 has the generally cylindrical shape of recessed fixtures. Fixture 14 has a ring 22 which supports the fixture 14 as it is centered on an opening 24 and provides fixture 14 with access to the area below the hung ceiling 12. The end of fixture 14 remote from the ring 22 is capped by a fixture end cover 16. The fixture end cover 16 can be seen to support a lamp socket 18 which has contained therein a lamp 20. When lamp 20 is on, it illuminates the area below the hung ceiling 12. Contained within the fixture end cover 16 is a cable opening 26 which allows a first cable 28 access to the interior of high hat fixture 14. The first cable 28 is connected to the lamp socket 18 and supplies power to the lamp 20. The other end of the first cable 28 enters a junction box 30. Junction box 30 has a support flange 32 which is used to attach the junction box 30 to the hung ceiling 12. Shown entering the junction box 30 is a second cable 34 which brings power to the lamp 20. A third cable 36 shown to the left of cables 28 and 34 connects a switch (not shown) which is typically mounted in the space below the hung ceiling 12 to control the flow of electricity to the lamp.

Projecting from the front of the junction box 30 is a self heating thermal protector 38. The self heating thermal protector 38 is attached to the junction box 30 by means of a mounting member of thermally insulating material. The self heating thermal protector consists of a heat source such as a resistor located proximate a bimetallic switch element, each of which is encapsulated within thermally conducting potting compound which is fire retardant and may be electrically insulating.

Figure 2:
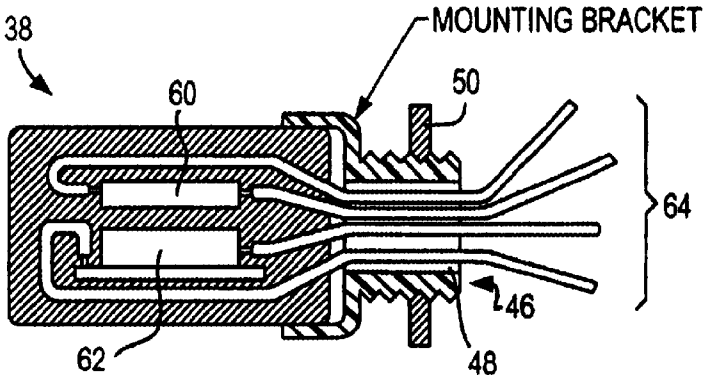
FIG. 2 is a cross sectional view of a self heating thermal protector in accordance with the principles of the invention.

FIG. 2 shows a side cut away view of a self heating thermal protector in accordance with the principles of the invention. A resistive type of heating element 60 and a bimetallic switch 62 located in close proximity to the heating element are encased within thermally conductive potting compound such as Cast-Coat CC#-301 AD-FR with H-7 hardener to form the self heating thermal protector. The potting compound is fire retardant and may also be electrically insulating. The thermal protector can have a cylindrical shape and supports, at one end thereof, a mounting member 46. The mounting member 46 has a central opening 48 for receiving electrical conductors 64 which connect the heating element and the bimetallic switch embedded within the potting compound to externally located circuitry. The mounting member 46 is adapted to be attached to an electrical junction such as junction box 30 of FIG. 1. To facilitate this attachment, the outer surface of the mounting member 46 is provided with a threaded surface adapted to engage a nut 50. The mounting member is composed of a thermosetting phenol material which provides thermal isolation between the supporting electrical junction box which is normally composed of metal and the body of the self heating thermal protector 38.

The mounting member 46 has a dual function. It provides a convenient method for mounting the self heating thermal protector and, in addition, provide thermal isolation of the thermal protector from the mounting structure (normally a metal electrical junction box which is usually a good thermal conductor).Thermal isolation of the thermal protector from an electrical junction box is desired to minimize the influence that the junction box will have on the thermal protector so that it remains primarily responsive to the surrounding air.

The heating element can be of carbon or metal composition, a bare wire wound on a core or wire encased within its own protective covering, either of which can be encapsulated within the potting compound. When the heating element is a bare wire, the potting compound should be electrically insulating. The bimetallic switch is located within a thermally conductive protective enclosure which is then encapsulated by the potting compound. The enclosure prevents the potting compound from interfering with the operation of the bimetallic elements of the switch.

Figure 3:
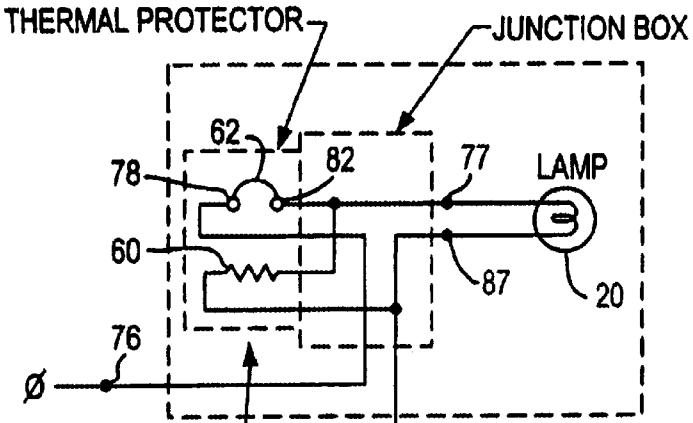
FIG. 3 is a schematic diagram of electrical connections of the self heating thermal protector.

FIG. 3 illustrates a schematic of one embodiment of the electrical connection of the present invention together with the lamp it serves. Within the dashed lines of FIG. 3 is an electrical circuit for interconnecting the various components. Power input is from a first input terminal 76 and a second input terminal 88 connected to a source of input power. The power output from the thermal protector is from output terminals 77 and 87. Within the self heating thermal protector 38 is bimetallic switch 62 having terminals 78, 82 and a resistor 60. Terminal 78 is connected to terminal 76; and terminal 82 is connected directly to terminal 77 and through resistor 60 to terminals 87 and 88. A fixture lamp 20 is connected across terminals 77, 87. The heat generating resistor 60 is located proximate the bimetallic switch 62.

Figure 4:
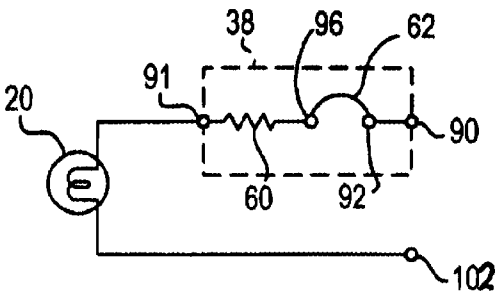
FIG. 4 is another schematic diagram of electrical connections of the self heating thermal protector.

FIG. 4 illustrates a second schematic wiring diagram of an electrical circuit for the present invention together with the lamp that it controls. Shown within the dashed line is the wiring schematic of a second embodiment of the self heating thermal protector of the present invention. Power to the fixture lamp 20 is obtained from terminals 91 and 102. The current which enters the output terminal 91 is obtained from an input terminal 90 which is connected directly to a power source as is input terminal 102. Disposed between terminals 90, 91 is the self heating thermal protector 38. Within the thermal protector is a bimetallic switch 62 having an input 92 directly connected to terminal 90. Output terminal 96 from the bimetallic switch 62 is connected to one end of a heat generating resistor 60. The other end of the heat generating resistor 60 is connected to terminal 91.

The operation of the self heating thermal protector of the present invention will be better understood from the following discussion taken together with the drawings.

FIG. 1 depicts the situation that exists when the high hat fixture 14 is installed in a hung ceiling 12. Typically, all electrical connections are made inside the junction box 30. The installation 10 shows the high hat fixture 14 surrounded by air thereby safely dissipating its internally generated heat. The temperature at the junction box 30 which is physically separate from the fixture is therefore low compared to the temperature of the high hat fixture 14. If the fixture 14 and the box 30 become surrounded or covered by insulation, a pocket is formed within which fixture 14 and box 30 fit, and the heat dissipated by the fixture 14 will heat the air in the pocket. This situation is a distinct possibility if thermal insulation is blown or foamed into the space within a hung ceiling. When this conditions exist, the temperature at the heat flow detector 38 will increase. The heat generated by the resistor 60 will be prevented from being dissipated to the surrounding air which will cause a further temperature increase at the heat flow detector 38. At this time the bimetallic switch 62 will open to disconnect the electricity from the lamp when the temperature in the hung ceiling area near the high hat fixture 14 may cause damage to the insulation on the wire or lead to a fire. The bimetallic switch is a mechanical switch which employs a bimetallic element to sense temperature. The bimetallic element distorts as the temperature is raised. A moderate bow assumed by the bimetallic element becomes more pronounced with an increase in temperature. As the bow increases, the contacts of the switch move away from each other and the electrical circuit to the lamp is opened.

Because of the relatively good thermal conductivity that exists between the heating element and the bimetallic switch, a minimal thermal gradient exists in the self heating thermal protector disclosed. Therefore, the surface temperature of the device is similar to the temperature of the bimetallic switch. With appropriate operating characteristics of the heater and the bimetallic switch, the convection cooling obtained from the surrounding air will keep the self heating thermal protector below the operating temperature of the bimetal switch and, therefore, prevent the switch from opening. But, if the surrounding air has restricted convection, as can occur if insulation is positioned adjacent to the fixture, the transfer of heat from the self heating thermal protector to the air will be reduced and the temperature of the self heating thermal protector will increase to a value that is above the temperature at which the contacts of the switch will open. The opening of the contacts causes the power to be removed from the lamp in the fixture to limit or prevent overheating of the fixture and the associated hazards of overheating such as insulation breakdown and fire.

The embodiment of the present invention herein described and disclosed are presented merely as examples of the invention. Other embodiments, forms and structures coming within the scope of this invention will readily suggest themselves to those skilled in the art, and shall be deemed to come within the scope of the appended claims.

What is claimed is:

1. A self heating thermal protector for recessed incandescent fixtures comprising:

an enclosure, a temperature sensitive switch located within the enclosure comprising a temperature sensitive movable element and an electrical contact integral thereto aligned to contact a fixed electrical contact, the contacts of the temperature sensitive switch being capable of being preset to open at a desired temperature by movement of the electrical contact integral with the movable element away from the fixed contact, a heat source located in proximity to the enclosure housing the temperature sensitive switch, and thermally conductive potting compound encapsulating both the enclosure having the temperature sensitive switch and the heat source located in proximity to the enclosure wherein restricted air flow over the thermally conductive potting compound effects opening of the electrical contacts during heating of the thermally conductive potting compound by the heat source.

2. The self heating thermal protector of claim 1 wherein the heat source comprises a resistor adapted to generate heat upon being energized from a source of electricity.

3. The self heating thermal protector of claim 2 wherein the thermally conductive potting compound is electrically insulating.

4. The self heating thermal protector of claim 2 wherein the enclosure is thermally conducting.

5. The self heating thermal protector of claim 2 further comprising:

a mounting member of thermal insulating material coupled to the thermal protector to thermally isolate the thermal protector from a support member.

6. The self heating thermal protector of claim 5 wherein the mounting member has an axially aligned opening for receiving conductive wires connecting the heat source to a source of electricity.

7. The self heating thermal protector of claim 2 wherein the resistor is of a carbon composition.

8. The self heating thermal protector of claim 2 wherein the resistor is of a metal composition.

9. The self heating thermal protector of claim 1 wherein the temperature sensitive switch is a bimetallic switch.

10. The self heating thermal protector of claim 5 wherein the mounting member of thermal insulating material is coupled to the thermally conductive potting compound encapsulating both the enclosure and the heat source.

* * * * *